US010132472B2

(12) United States Patent
Joseph

(10) Patent No.: US 10,132,472 B2
(45) Date of Patent: Nov. 20, 2018

(54) THEATRICAL PROP FOR PROVIDING REPEATABLE, DAYLIGHT-VIEWABLE MUZZLE FLASHES

(71) Applicant: DISNEY ENTERPRISES, INC., Burbank, CA (US)

(72) Inventor: Daniel M. Joseph, Los Angeles, CA (US)

(73) Assignee: DISNEY ENTERPRISES, INC., Burbank, CA (US)

( * ) Notice: Subject to any disclaimer, the term of this patent is extended or adjusted under 35 U.S.C. 154(b) by 162 days.

(21) Appl. No.: 15/372,835

(22) Filed: Dec. 8, 2016

(65) Prior Publication Data

US 2018/0163949 A1 Jun. 14, 2018

(51) Int. Cl.

| | |
|---|---|
| ***F21V 14/02*** | (2006.01) |
| ***F21V 3/00*** | (2015.01) |
| ***F21V 23/04*** | (2006.01) |
| ***F21W 131/406*** | (2006.01) |
| ***F21Y 115/10*** | (2016.01) |
| ***F41A 33/02*** | (2006.01) |

(52) U.S. Cl.

CPC ..... *F21V 14/02* (2013.01); *F21V 3/00* (2013.01); *F21V 23/0407* (2013.01); *F41A 33/02* (2013.01); *F21W 2131/406* (2013.01); *F21Y 2115/10* (2016.08)

(58) Field of Classification Search

CPC ... F21V 14/02; F21W 2131/406; F41A 33/02; G03B 15/02; G03B 15/0442

USPC ..... 362/111, 112, 113

See application file for complete search history.

(56) References Cited

U.S. PATENT DOCUMENTS

| | | | | |
|---|---|---|---|---|
| 4,367,516 A * | 1/1983 | Jacob | F41G 3/2655 | 362/111 |
| 4,830,617 A * | 5/1989 | Hancox | F41A 33/02 | 362/111 |
| 6,146,141 A * | 11/2000 | Schumann | F41A 33/02 | 434/11 |
| 7,033,175 B2 * | 4/2006 | Kunimoto | F41A 33/02 | 434/18 |
| 8,641,198 B2 * | 2/2014 | Feliciano | G03B 21/26 | 352/95 |
| 9,746,272 B2 * | 8/2017 | Lowrance | F41A 33/02 | |

* cited by examiner

*Primary Examiner* — William N Harris

(74) *Attorney, Agent, or Firm* — Marsh Fischmann & Breyfogle LLP; Kent A. Lembke

(57) ABSTRACT

An apparatus for generating light-based special effects viewable in daylight. The apparatus includes a barrel with opaque sidewalls defining an interior space accessible via a muzzle. The apparatus includes a light element positionable within the interior space and further includes a light positioning assembly. The apparatus includes a trigger element operable to receive user input to initiate operations of the light element and the light positioning assembly. A controller is provided that responds to the user input to operate the light positioning assembly to first move the light element out of the interior space through the muzzle and to second retract the light element back into the interior space. The controller concurrently operates the light element to generate the light when the light element is moved out of the interior space and to terminate the generating of the light when the light element is retracted back into the interior space.

20 Claims, 4 Drawing Sheets

THEATRICAL PROP FOR PROVIDING REPEATABLE, DAYLIGHT-VIEWABLE MUZZLE FLASHES

BACKGROUND

1. Field of the Description

The present description relates, in general, to theatrical and other visual display props and special effect devices used to provide lighting in outdoor or daylight settings and, more particularly, to a special effect device (or "theatrical prop" or "theatrical prop lighting assembly" or the like) adapted to provide short-lived (e.g., milliseconds in duration) flashes of light (also called "muzzle flashes" herein) that are viewable in direct sunlight such as in an outdoor entertainment or theatrical venue or setting.

2. Relevant Background

In the entertainment industry, there are many settings or venues where it is desirable to provide entertainment in an outdoor setting or venue. For example, many cities have amphitheater and other facilities where theater groups present plays or bands provide concerts. In another example, theme parks may have outdoor worlds in which parades and shows may be provided to entertain each park's guests. An ongoing challenge in such outdoor entertainment venues or environments is how to achieve lighting-based special effects when these outdoor settings are used during daylight hours. Particularly, during the daytime, sunlight illuminates the actors, the sets, and any props, and it can be very difficult to replicate lighting effects that are easily achieved with conventional lighting systems in dark or light-controlled theatrical spaces.

One particular problem with providing daylight entertainment is how to provide bright flashes of light, and especially short-lived flashes, that can be observed and that can readily be repeated in a reliable and controllable manner. For example, there are many theatrical plays and shows where weapon-based battles or conflicts are recreated by actors for a crowd, and, in such settings, the actors may carry props that simulate historical weapons or guns, existing weapons, or even futuristic weapons. In each of these examples, it is desirable for a lighting-based effect to be used to provide the illusion that the theatrical prop has been fired by the actor or that a muzzle flash has occurred.

In some cases, the live theatrical performance is attempting to recreate a scene from a movie in which prop weapons are fired resulting in explosions and flashes (muzzle flashes) of volumetric light that comes out of the muzzle of the prop weapon with each firing. For a movie, this special effect is created post production with computer graphic imagery (CGI) or other tools. However, it has proven very difficult to provide a similar volumetric light flash effect for a character carrying a hand-held prop. Particularly, it has not been possible with conventional special effect devices to provide a prop that the actor or user can operate to choose when their prop weapon is fired and that provide a "wow" illusion for viewers even when used in an outdoor theatrical venue in direct sunlight as well as in darker settings or nighttime performances.

SUMMARY

Briefly, a special effects device (or theatrical prop or theatrical prop lighting assembly) is provided that includes a flash delivery assembly supported within or on a housing (or carrier). Specifically, the flash delivery assembly includes a barrel housing a flash or light element and a light positioning assembly or device that, in response to a trigger (e.g., a control signal from an on/off switch or triggering element), acts quickly (e.g., a number of milliseconds or a fraction of a second) to move the flash/light element from a retracted position within an interior space of the barrel to a position outside the barrel (e.g., an exposed position outside the muzzle of the barrel).

The flash/light element may include one or more light sources (such as one or more light emitting diodes (LEDs)) chosen to provide a very bright light (e.g., 2000 to 5000 lumens or more), and, after a very short extended duration (e.g., less than a second such as several milliseconds), the light positioning assembly acts to retract the light source back into the interior space of the barrel where it is hidden (and, typically, turned off so it stops emitting light). The flash/light element may also include a housing or enclosure to further the muzzle flash illusion such as an irregular shaped, hollow piece of translucent plastic or the like in which the light source (e.g., an LED) is positioned. In one prototype, the outer surfaces of the light source housing are shaped in the form of a group of flames (e.g., a rectangular base with a volumetric flamed or jagged peak top to enclose a light source(s)).

Operation of the special effects device or theatrical prop provides a light-based effect that provides the illusion that a physical thing or object is ejected or shot of the end of the barrel's muzzle and that a real explosion has occurred. The special effects device or theatrical prop can be controlled or triggered by the operator to "fire" or be shot off repeatedly without maintenance or "reloading" as may be required for a pyrotechnic-type device and without any possible danger as would be the case with pyrotechnics.

The special effects device or theatrical prop provides a significant improvement over past devices that used a light fixed at the end of a gun muzzle as this light is always present and visible to viewers especially in daylight settings. The prior techniques may have also been more complex as they added mist or fog. A problem with prior devices was that they never wholly looked real as nothing was actually traveling out of the muzzle. Another issues with prior devices using fog/mist is that they were not portable since a fog/water supply was required. Other devices used an actual but small pyrotechnic. These, however, had to be reloaded and typically only can be loaded or configured to have a finite number of shots and their use presents a number of safety concerns. In contrast, the new theatrical prop can be fired over and over again without any expendables or need for reloading. It also appears during its use to creatively look much more like a "real life CGI" effect, such that it is useful for recreating well-known and/or crowd-expected movie scenes. Some planned models of the theatrical prop can be used by human characters during a theatrical performance or may be put on animatronic or robotic creatures or figures for automated operations during displays or shows.

More particularly, an apparatus is provided for generating light-based special effects viewable in daylight and other brightly lit settings. The apparatus (or theatrical prop or special effects device) includes a barrel with opaque sidewalls defining an interior space accessible via a muzzle. The apparatus also includes a light element positionable within the interior space, the light element being operable to selectively output light and further includes a light positioning assembly. The apparatus further includes a trigger element operable to receive user input to initiate operations of the light element and the light positioning assembly. A controller is provided that responds to the user input to operate the light positioning assembly to first move the light element at least partially out of the interior space through the muzzle and to second retract the light element back into the interior space. The controller concurrently operates the light element to generate the light when the light element is moved out of the interior space and to terminate the generating of the light when the light element is retracted back into the interior space.

The operations of the light positioning assembly are both performed very rapidly such less than 1 second (e.g., within milliseconds). To perform this rapid positioning, the light positioning assembly may include a pneumatic actuator (e.g., an air cylinder) operable to move the light element out of the interior space of the muzzle and a spring-based return element to retract the light element back into the interior space. In other cases, though, the light positioning assembly includes an electric actuator (or solenoid-based device) operable to move the light element out of the interior space of the muzzle and a return element (mechanical such as a spring or electrical) to retract the light element back into the interior space. In some cases, the light positioning assembly extends the light element out a distance of at least 2 inches (such as 4 or more inches) past the muzzle when the light element is moved out of the interior space of the barrel.

In some embodiments, the light element includes a 1000-Lumen or greater light source. For example, the light element is a white light emitting diode (LED) with a rating in the range of 1000 to 5000 Lumens. The light element further may include an enclosure housing the light source, and the enclosure may be a hollow, volumetric shape formed of plastic, glass, or ceramic to be transparent-to-translucent to light that may have a length exceeding a length of excursion of the light element from the muzzle (and, in some cases, a conical end that may simulate an explosion/muzzle flash with a plurality of flame shapes). In some cases, the interior space is defined by inner surfaces of the sidewalls of the barrel, the inner surfaces are colored black, and exterior surfaces of the transparent enclosure are painted or dyed with transparent paint or dye. In the same or other cases, a colored lens or gel is applied to one or more interior surfaces of the enclosure to color the light output by the light source.

DETAILED DESCRIPTION OF THE PREFERRED EMBODIMENTS

Briefly, a theatrical prop (also called a special effects device) is described that is operable to provide a visual effect that is visible even in daylight venues. The visual effect is a light-based effect that simulates an explosion or similar event that causes a bright flash of light. Particular embodiments of the theatrical prop provide this "explosion" or bright light flash is provided at the end of a barrel of a simulated weapon such as a historical gun or a futuristic gun (e.g., a laser blaster or the like). When operations of the theatrical prop is initiated or "triggered" by an operator (e.g., an actor in a theatrical production), a light or flash element is quickly moved (by a light positioning assembly) from a concealed location within the interior space of a barrel to an exposed location outside barrel by moving it quickly out the barrel's muzzle. A light source(s) is turned on (powered on)) while the light element is exposed (extended outward from the barrel's muzzle) to create the bright flash and also to provide the illusion that an object has traveled out of the barrel. Then, the light or flash element is retracted back into the barrel's interior space, and the light source(s) is turned off (powered off).

Figure 1:
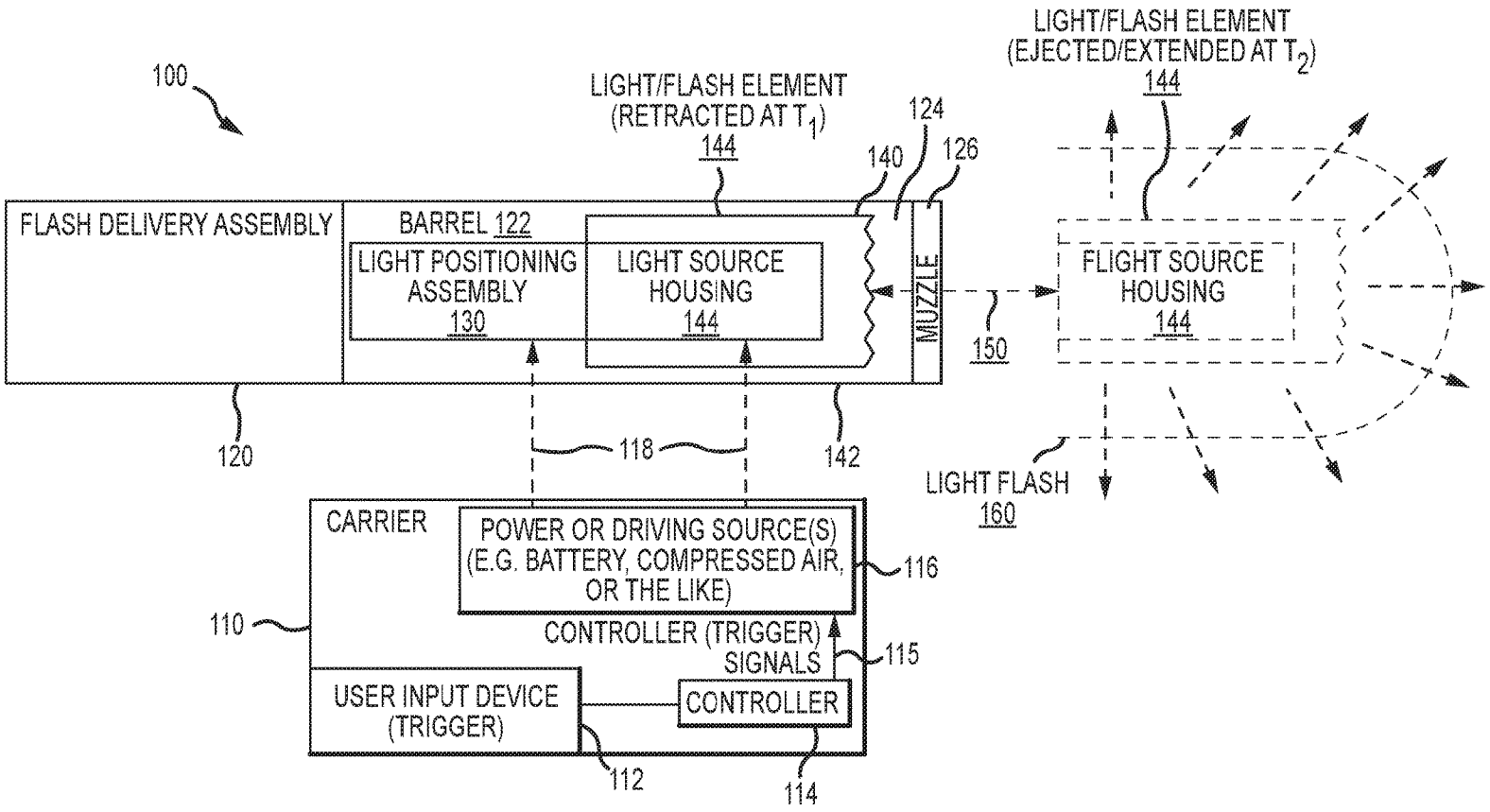
FIG. 1 is a functional block diagram of a special effects device (or theatrical prop) showing its operations to move a light/flash element between a retracted/hidden position and an ejected/exposed position.

FIG. 1 is a functional block diagram of a special effects device (or theatrical prop) 100 showing its operations to move a light/flash element 140 between a retracted/hidden position and an ejected/exposed position to generate a bright flash of light ("explosion" of light) that is visible even in brightly lit venues (e.g., during daytime outdoor shows or displays). The special effects device 100 includes a carrier or stock 110 (or housing) for supporting a flash delivery assembly 120 and facilitating a user/operator (e.g., an actor in a show) to carry and use the special effects device 100 (e.g., to make the device 100 a hand-held prop or the like). The carrier/stock 110 may take nearly any form to practice the device 100 and may be designed to have the appearance of a simulated weapon for a particular theatrical show (e.g., appearance of a futuristic weapon from a particular movie or the like).

A user input device or trigger 112 is provided on the carrier 110 to allow a user/operator to initiate operations (to trigger) the special effects device 100 to provide the bright light flashing effect (e.g., to cause the prop weapon to "fire"). The user input device/trigger 112 is linked as shown at 113 to a controller 114, which may take the form of relatively simple set of hardware/software, that generates control signals or trigger signals 115. These signals 115 are used to operate one or more power sources 116 in the carrier 110 (or coupled with the carrier 110 or to the light positioning assembly 130 through the carrier 130 (such as with tubing, wiring, and the like)), which are shown to be linked to the light positioning assembly 130 and light source(s) 144 so as to power or trigger the operations of these two devices in a concurrent (or very closely timed sequential manner such as eject and fire the light source 142 or perform both concurrently). In some embodiments, the controller 114 triggers the light positioning assembly 130 and the light source 144 via relays, and both are triggered concurrently (On/Off together for same period of time such as when an air cylinder is supplied air an LED is On).

On (or in) the carrier 110, a flash delivery assembly 120 is provided, and this assembly 120 includes a barrel 122 with an opening or muzzle 126 at one end that provides access to the interior space 124 within the barrel 122. For example, the barrel 122 may be cylindrical in shape with a length and bore/inner diameter to create an interior space 124 large enough to contain all or portions of a light positioning assembly 130 and light/flash element 140, and the shape and size of the barrel 122 may be chosen to replicate a movie or story-based weapon's barrel. The barrel 122 is also formed so as to be opaque and hide the light/flash element 140 when it is retracted.

The light positioning assembly 130 is configured (or chosen if off-the-shelf) to be able to respond to a control/trigger signal 115 to very quickly (fraction of a second) move the light/flash element 140 from a first or retracted position within the interior space 124 of the barrel 122 to a second or extended position in which at least a portion of the light/flash element 140 is moved through the muzzle 126 and is extending a distance past the end of the barrel 122. These "firing" operations can be seen in FIG. 1 with the light/flash element 140 in a retracted position at a first time, $T_1$ (before triggering by operations of the user input device/trigger 112) and at a second time, $T_2$ (upon triggering) with the light/flash element 140 in an extended position outside the barrel 122. The travel or excursion may vary, too, but some embodiments based on the size of the housing 142 and/or light source 144, with some embodiments having an excursion in the range of 2 to 8 inches (with one prototype having a 3.5 to 4.5-inch excursion (e.g., extend 3 to 4 inches out and be recessed from the muzzle by 0.5 inches when retracted)). Although not shown, the controller 114 may also trigger corresponding sound effects during the "firing" operations such as with on-board Bluetooth/WiFi devices, with on-board speakers or off-board sound systems.

The light positioning assembly 130 may take a wide variety of forms to practice the device 100 as long as it is configured to provide the fast extension and retraction actions (within a fraction of a second so the human eye perceives movement out of the barrel 122 but does not perceive specific shape of the extended object or the retraction (in most cases)). In one example, the light positioning assembly 130 takes the form of a pneumatic device, and the power source 116 takes the form of pressurized (or compressed) air. For example, the assembly 130 may be a pneumatic cylinder with the light/flash element attached at the end of a rod at the end of this cylinder. A spring or other type of return may be used to automatically retract the rod into the cylinder upon removal of driving/powering air from power or driving source 116 (e.g., the positioning assembly 130 may include a pneumatic or air cylinder (or actuator) available from Bimba Manufacturing Company or the like). In other embodiments, an electric actuator may be used to allow the device 100 to be more portable (e.g., not require a compressed air source) with the power source 116 taking the form of a battery. Again, a spring or similar return may be used to retract the "fired" actuator 130 and return the light/flash element 140 to its retracted position where it is hidden from view within the interior space 124 of the barrel 122.

The light/flash element 140 is shown to include a light source 144 positioned within a housing/enclosure 142, which is coupled to the driving end of the actuator of the light positioning assembly 130. The source 144 may take the form of an LED with high illumination capabilities such as 1000 to 5000 or more Lumens with one embodiment using a 5000-Lumen LED (e.g., from Cree or the like). The enclosure 142 may enclose this LED or include the LED box, and it further may include an extension or optical component that extends outward from the LED box to provide a volumetric aspect and to disperse the light from the source 144 during each flash. In some embodiments, the housing 142 is not rigid but is adapted to increase in form factor or volume as it passes through the muzzle 126 and to then be retracted to its original/hidden volume upon retraction of the light/flash element 140 within the barrel by the light positioning assembly 130.

For example, the housing 142 may be formed of a transparent to translucent plastic (or glass or ceramic) that is shaped generally conical but often with an irregular surface such as a group of flames to further the illusion of an explosion or laser blast coming out of the muzzle 126 of the barrel 122. In some embodiments, the exterior of the housing 142 is painted or covered with a transparent black paint (or dyed with a transparent black dye) so as to hide its existence from view when the light/flash element 140 including the housing 142 are retracted back into the interior space 124 of the barrel 122. The interior space 124 (or inner walls of the barrel 122) may also be black (or dark colored) to further hide its contents (hide the light/flash element 140 and housing 142). The color of the light source 144 may vary, but some embodiments create desired effect of an explosion by using a white LED (as these are available in brighter rangers than colored LEDs) combined with a colored gel/lens inside the housing 142 (e.g., a red gel) to get color through the transparent black paint/dye on the outer surfaces of the housing 142.

Figure 2A:
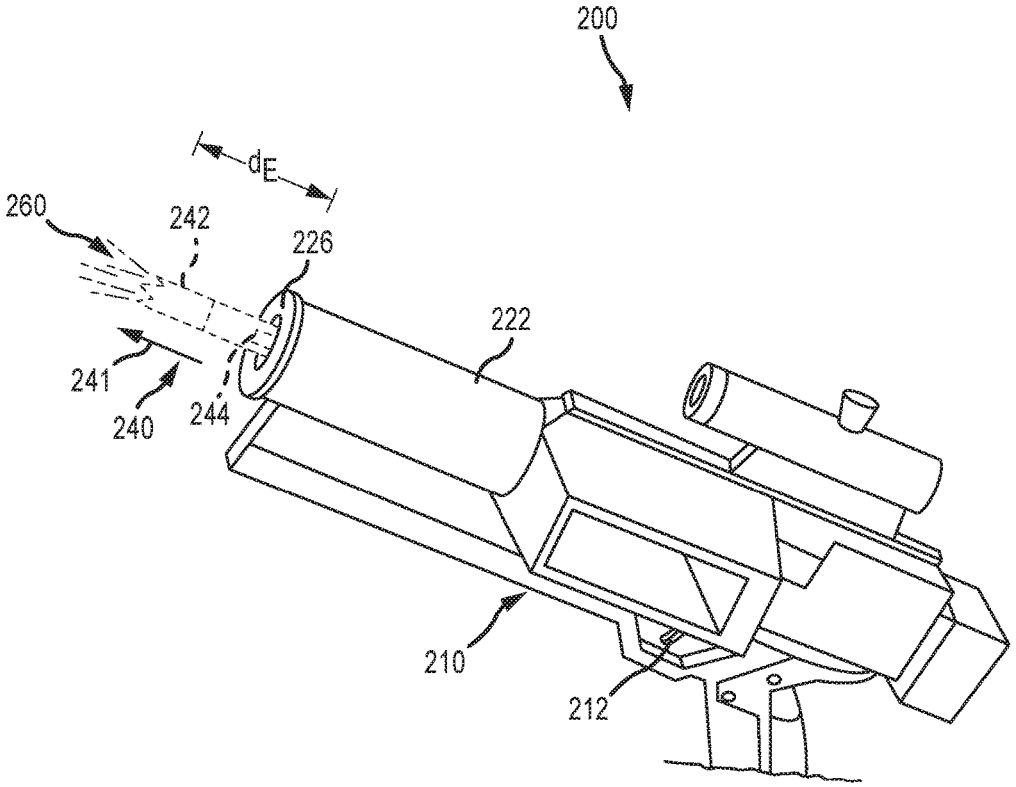
FIGS. 2A and 2B illustrate one prototype of the theatrical prop of the present description (e.g., an embodiment of the device of FIG. 1) showing it during operations to provide the light-based special effect (e.g., a triggered explosion at the end of a barrel or a muzzle flash) and during operations after (or prior) completion of the light-based special effect (e.g., with the light/flash element retracted back into the barrel's interior space where it is hidden from view)
Figure 2B:
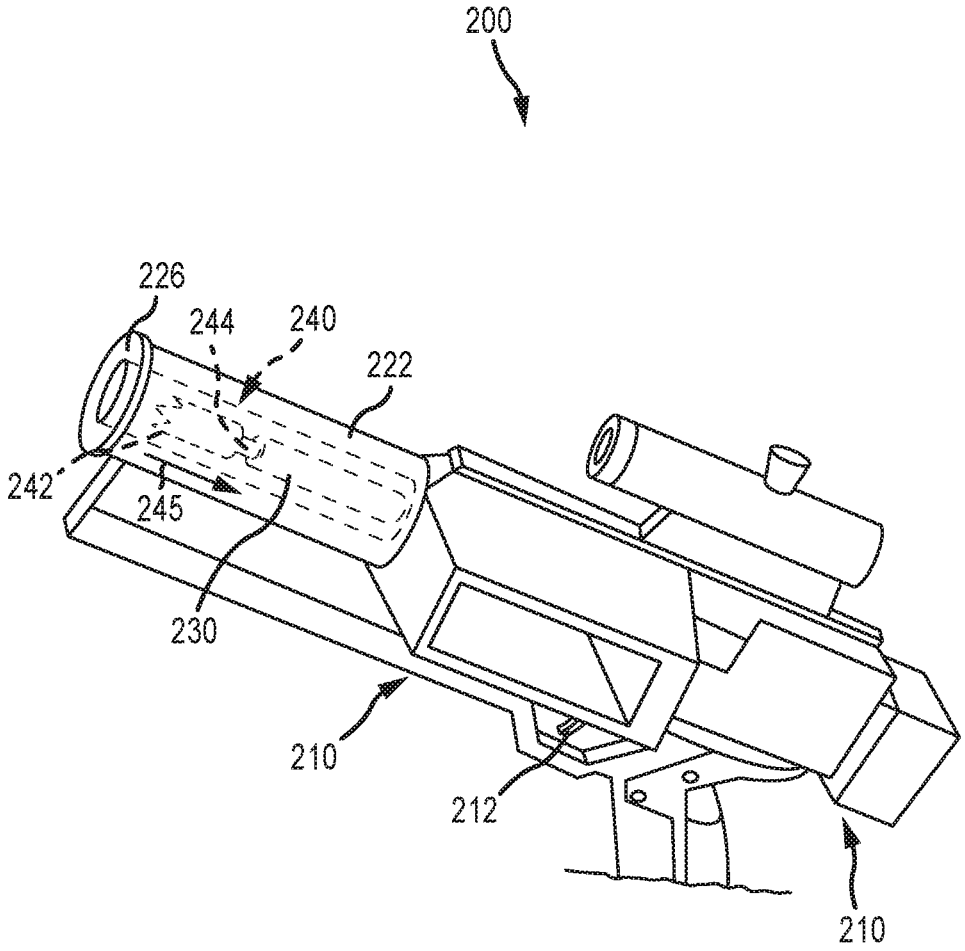

FIGS. 2A and 2B illustrate one prototype of the theatrical prop 200 of the present description (e.g., an embodiment of the device of FIG. 1). The prop (or special effects device) 200 is shown in FIG. 2A during operations to provide the light-based special effect, e.g., a triggered explosion at the end of a barrel or a muzzle flash, as seen at 260 and is shown in FIG. 2B during operations after (or prior) completion of the light-based special effect, with the light/flash element 240 retracted back into the barrel's interior space where it is hidden from view.

As shown in FIGS. 2A and 2B, the prop 200 includes a carrier or stock 210 from which a user input or trigger element 212 is accessible (e.g., at a lower portion of the carrier 210 or any other exposed surface of the carrier 210) to an operator or user of the prop 200 (e.g., an actor in a show may carry the prop 200 and, when the light-based effect or muzzle flash is desired, pull the trigger 212). The prop 200 also includes a barrel 222 that is coupled with or supported upon/by the carrier/stock 210, and the barrel 222 includes an interior space (e.g., a cylinder) not shown in FIG. 2A that opens up at one end with a muzzle 226 of the barrel 222.

FIG. 2A shows the prop 200 when its light-based effects 260 have been triggered via operation of the trigger/user input element 212. A controller/relay inside the carrier 210 operates (as discussed with reference to FIG. 1 and prop 100) to trigger or initiate concurrent operations of the flash delivery assembly and to power on a light source(s) to provide a flash of light as the light element is moved out of the barrel 222. This can be seen with the prop 200 as the light element 240 has been extend out or ejected from the interior space of the barrel 222 via the muzzle 226 with this outward movement shown with arrow 241.

In this example, the flash delivery assembly has moved 241 the light element 240 physically out of the barrel 222 an excursion distance or length, $d_E$, such as 1 to 6 inches or more with 2 to 4.5 inches being useful in some cases (with one prototype having a 4-inch excursion). Correspondingly, the enclosure or housing 242 of the light element 240 has a length matching or exceeding the excursion distance, $d_E$, such that all of the light element enclosure 242 is moved out of the barrel 222 or a portion is retained within the interior space of the barrel 222 when the light element 240 is moved 241 out of the barrel 222. The enclosure 242 is shown to have a rectangular base portion that is attached to the flash delivery assembly and has outer dimensions less than the bore of the interior space of the barrel 222, and this base portion houses the light source 244 (e.g., the base portion may be provided as an LED box or the like). The outer-most portion of the enclosure 242 may be configured to further the volumetric effect and/or appearance of the light element 240 during its extension/ejection from the barrel 222, and it may be generally conical in shape (with the cone tip distal from the barrel 222 when the element 240 is ejected/extended 241) with the specific embodiment being a plurality of 3D flames to further the illusion of an explosion or muzzle flash coming out of the muzzle 226 of the barrel 222.

As shown, the light source 244 is housed within the transparent-to-translucent enclosure 242. The light source 244 is "on" or has powered from a battery or other power source provided to it during the ejection/extension 241 such that it emits light that hits the interior surfaces of the housing 242 and passes through the enclosures sidewalls to provide the "ball" or cylindrical-shaped column of bright light (e.g., "bright" as the source 244 may be a 1000 to 5000-Lumen or brighter LED in some preferred embodiments). The source 244 may be colored to provide the light 260 as colored light or the coloring may come from a lens within or on the enclosure 240 and/or a coloring medium (such as a red or other colored gel provided on the interior spaces of the enclosure 242 such as within the outer, conical shaped tip portion of the enclosure 242).

FIG. 2B shows that the light source 244 and the light positioning assembly 230 (e.g., a pneumatic actuator or air cylinder in this example) are operated concurrently after the flash effect is completed to hide the light element 240 within the barrel 222. To this end, the light positioning assembly 230 typically is deactivated (e.g., supply of compressed air when the assembly 230 includes an air cylinder, supply of electricity when the assembly 230 utilizes an electric actuator/solenoid, and the like) and a return device such as a spring-based component acts to automatically retract 245 the light element 240 back into the interior space of the barrel 222. The light source 244 is turned "off" or has its electric power source switched to terminate electricity flow to the source 244 such that it stops emitting light as it is retracted 245 (and when it is positioned within the barrel 222 until it is again ejected from the barrel 222).

To hide the presence of the light element 240 in the barrel 222, the retraction 245 typically is configured to move the outer end/tip of the enclosure 242 past the muzzle 226 (e.g., 0.25 to 1 inch within the barrel's interior space). Further, the inner walls defining the interior space of the barrel 222 may be darkly colored (e.g., painted black or another color), and the exterior surfaces of the enclosure 242 may also be painted or dyed a dark color (e.g., paint or dye the exterior surfaces of at least the outer end/tip of the enclosure with transparent black paint or dye).

Figure 3:
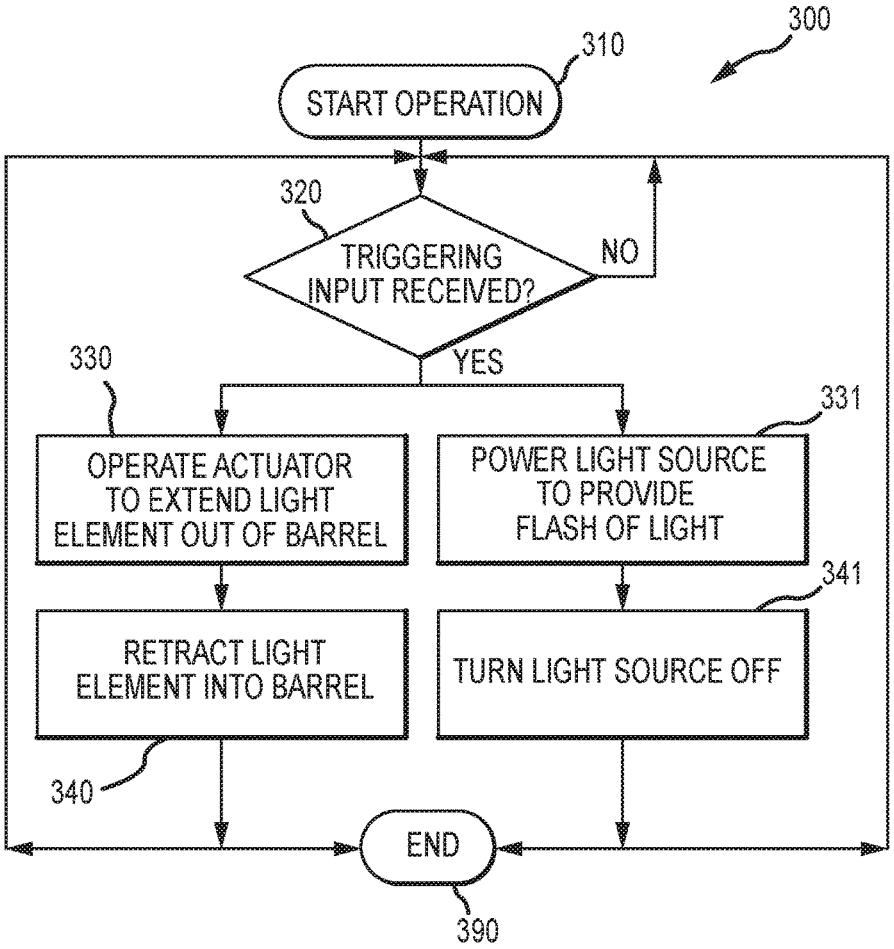
FIG. 3 is a flow diagram of a method of operating a special effects device of the present description such as operation of the devices shown in FIGS. 1-2B.

FIG. 3 illustrates one method 300 of operating a special effects device (such as devices 100 and 200) of the present description to provide a muzzle flash-type effect that is viewable even in brightly lit settings such as during a daytime, outdoor (sunlit) venue. The method 300 starts at 310 such as with providing an actor (or actors) of a show with a special effects device or theatrical prop as taught herein. At 320, the method 300 continues with determining whether or not a triggering input has been received (e.g., has the trigger been pulled/activated or a user input element been operated?). If not, the method 300 continues at 320 with waiting for a triggering activity/action.

If a triggering input is detected/received at 320, the method 300 continues concurrently with performance of steps 330 and 331. In step 330, the method 300 includes operating the actuator (or light positioning assembly 130 such as an air cylinder or electric solenoid) to extend the light element (or a portion of the light element) out of the barrel of the special effects device (e.g., extend a light source enclosure out 2 to 6 inches or more from the muzzle of the barrel). In step 331, the light source is powered or switched on to cause it to provide a bright flash of light (in and out of the end of the barrel or at and just past the muzzle of the barrel).

Next, the method 300 involves performing steps 340 and 341 concurrently (or at least partially concurrently as the retraction may take longer than the powering off of the light source). In step 340, the actuator/light positioning assembly operates to retract the light element into the interior space of the barrel (e.g., a predefined distance past the muzzle). In step 341, the light source is powered or switched off so that the light source no longer emits or generates light while it is positioned within the barrel's interior space. The method 300 may then continue at 320 with waiting for a next triggering action/input or may end at 390.

Although the invention has been described and illustrated with a certain degree of particularity, it is understood that the present disclosure has been made only by way of example, and that numerous changes in the combination and arrangement of parts can be resorted to by those skilled in the art without departing from the spirit and scope of the invention, as hereinafter claimed.

I claim:

1. An apparatus for generating light-based special effects viewable in daylight and other brightly lit settings, comprising:

a barrel with opaque sidewalls defining an interior space accessible via a muzzle;

a light element positionable within the interior space, the light element being operable to selectively output light;

a light positioning assembly;

a trigger element operable to receive user input to initiate operations of the light element and the light positioning assembly; and a controller responding to the user input to operate the light positioning assembly to first move the light element at least partially out of the interior space through the muzzle and to second retract the light element back into the interior space, wherein the controller concurrently operates the light element to generate the light when the light element is moved out of the interior space and to terminate the generating of the light when the light element is retracted back into the interior space.

2. The apparatus of claim 1, wherein the operations of the light positioning assembly are both performed in less than 1 second.

3. The apparatus of claim 1, wherein the light positioning assembly comprises a pneumatic actuator operable to move the light element out of the interior space of the muzzle and a spring-based return element to retract the light element back into the interior space.

4. The apparatus of claim 1, wherein the light positioning assembly comprises an electric actuator operable to move the light element out of the interior space of the muzzle and a return element to retract the light element back into the interior space.

5. The apparatus of claim 1, wherein the light positioning assembly extends the light element out a distance of at least 2 inches past the muzzle when the light element is moved out of the interior space of the barrel.

6. The apparatus of claim 1, wherein the light element comprises a 1000-Lumen or greater light source.

7. The apparatus of claim 6, wherein the light element comprises a white light emitting diode (LED) with a rating in the range of 1000 to 5000 Lumens.

8. The apparatus of claim 6, wherein the light element further comprises an enclosure housing the light source and wherein the enclosure is transparent-to-translucent to light and has a length exceeding a length of excursion of the light element from the muzzle.

9. The apparatus of claim 8, wherein the interior space is defined by inner surfaces of the sidewalls of the barrel, wherein the inner surfaces are colored black, and wherein exterior surfaces of the enclosure are painted or dyed with transparent black paint or dye.

10. The apparatus of claim 8, wherein a colored lens or gel is applied to one or more interior surfaces of the enclosure to color the light output by the light source.

11. An apparatus for providing flashes of light in a repeatable manner, comprising:

a barrel with an interior space accessible through an open end of the barrel;

a light element positioned in the interior space, the light element comprising a light source and an enclosure housing the light source;

an actuator attached to a first end of the enclosure operable for moving the enclosure between a first position wholly within the interior space and a second position with at least a second end opposite the first end a distance from the open end of the barrel; and a controller operating the actuator to move the light element from the first position to the second position and back to the first position, wherein the controller concurrently operates the light source to generate light when the enclosure is moved to the second position and to halt generation of the light when the enclosure is moved to the first position, and wherein the actuator moves the enclosure from the first position to the second position and back to the first position in less than one second.

12. The apparatus of claim 11, wherein the actuator comprises a pneumatic actuator or electric actuator operable to move the enclosure out of the interior space through the open end of the barrel and a spring-based return element to retract the enclosure from the second position to the first position.

13. The apparatus of claim 11, wherein the enclosure travels through an excursion length in the range of 2 to 6 inches when moved from the first position to the second position.

14. The apparatus of claim 11, wherein the light element comprises a 1000-Lumen or greater light source.

15. The apparatus of claim 14, wherein the light element comprises a white light emitting diode (LED) with a rating in the range of 1000 to 5000 Lumens.

16. The apparatus of claim 11, wherein the enclosure is transparent-to-translucent to light and wherein exterior surfaces of the enclosure are painted or dyed with transparent black paint or dye.

17. The apparatus of claim 16, wherein a colored lens or gel is applied to one or more interior surfaces of the enclosure to color the light output by the light source.

18. An apparatus for generating light-based special effects viewable in daylight and other brightly lit settings, comprising:

a barrel with sidewalls defining an interior space accessible via a muzzle;

a light element positionable within the interior space;

a light positioning assembly; and a controller responding to user input to operate the light positioning assembly to first move the light element at least partially out of the interior space through the muzzle and to second retract the light element back into the interior space, wherein the controller concurrently operates the light element to generate the light when the light element is moved out of the interior space and to terminate the generating of the light when the light element is retracted back into the interior space, wherein the light element comprises light emitting diode (LED) with a rating in the range of 1000 to 5000 Lumens, wherein the light element further comprises an enclosure housing the light source, and wherein exterior surfaces of the enclosure are painted or dyed with transparent black paint or dye.

19. The apparatus of claim 18, wherein the LED is a white LED with a rating in the range of 1000 to 5000 Lumens and wherein a colored lens or gel is applied to one or more interior surfaces of the enclosure to color the light output by the light source.

20. The apparatus of claim 18, wherein the operations of the light positioning assembly are both performed in less than 1 second and wherein the light positioning assembly comprises a pneumatic or electric actuator operable to move the light element out of the interior space of the muzzle and a spring-based return element to retract the light element back into the interior space.

* * * * *